United States Patent [19]

Hrboticky

[11] Patent Number: 4,802,497

[45] Date of Patent: Feb. 7, 1989

[54] TOBACCO FEED SYSTEM FOR CIGARETTE MAKING MACHINE

[75] Inventor: Karel Hrboticky, Etobicoke, Canada

[73] Assignee: Molins PLC, London, England

[21] Appl. No.: 136,938

[22] Filed: Dec. 27, 1987

[30] Foreign Application Priority Data

Jan. 2, 1987 [GB] United Kingdom ..... 8700025

[51] Int. Cl.[4] ..... A24C 5/14

[52] U.S. Cl. ..... 131/109.1; 131/109.2; 131/108; 131/84.3

[58] Field of Search ..... 131/108, 109.1, 109.2, 131/110, 84.3, 84.4

[56] References Cited

U.S. PATENT DOCUMENTS 4,458,698 7/1984 Brackmann ..... 131/109.1

4,459,999 7/1984 Brackmann et al. ..... 131/109.1

4,627,447 12/1986 Brackmann et al. ..... 131/109.1

*Primary Examiner*—V. Millin

*Assistant Examiner*—J. Welsh

*Attorney, Agent, or Firm*—Antonelli, Terry & Wands

[57] ABSTRACT

A system for feeding tobacco pneumatically and continuously to a cigarette making machine includes a fan (34,116; 148) which draws air through the machine via a suction band (48) and via one or more screens (96,98) and also serves to draw air through a duct by which tobacco is conveyed to the hopper (10) of the cigarette making machine from a tobacco sending device (12). The interior of the hopper is at subatmospheric pressure. This system avoids the need for an air lock in the hopper.

23 Claims, 2 Drawing Sheets

TOBACCO FEED SYSTEM FOR CIGARETTE MAKING MACHINE

This invention relates to a method and device for feeding tobacco particles from a source of cut, unopened tobacco to form a continuous tobacco filler on a moving air-permeable suction band in a cigarette making machine.

In the manufacture of cigarettes, tobacco is usually conveyed pneumatically to a cigarette making machine from a central "primary" apparatus serving a number of cigarette making machines. This system comprises generally a tobacco sender apparatus (part of the primary apparatus) which includes a source of cut tobacco, and means for feeding tobacco particles into a tobacco conveying air stream which conveys the tobacco to a hopper apparatus associated with the cigarette making machine. This sender apparatus is generally operated under vacuum. A central fan acting through a vacuum distribution ducting is usually the source of the vacuum. An airlock at each cigarette making machine must be used to isolate the subatmospheric pressure existing in the sender apparatus from the ambient atmospheric pressure prevailing in a conventional cigarette making machine hopper. From the airlock the tobacco is discharged into the hopper, while tobacco dust remaining in the air may be separated from the air in a central filter located in the neighbourhood of the central fan.

It has commonly been the practice for tobacco to be delivered to the cigarette machines intermittently, each period of delivery being sufficient to fill a discharger device which then dumps a set quantity of tobacco in the hopper apparatus when the hopper apparatus calls for tobacco. However, there have been proposals for feeding tobacco continuously or nearly continuously to each hopper apparatus, and this invention is more specifically concerned with such systems.

A conventional hopper apparatus generally comprises a tobacco storage zone and premetering, metering and opening devices which act on the tobacco to produce a wide thin stream of separated tobacco particles which are entrained by an air stream and conveyed to the air-permeable suction band. Two fans located in the cigarette making machine are normally utilized. One fan creates a vacuum for application to the suction band, and the second fan (sometimes termed the "supercharger") increases the tobacco conveying air flow towards the suction band. Excess tobacco, trimmed from a continuous tobacco layer on the suction band, is mechanically conveyed back to the hopper. However, some machines have omitted the second fan. An early example of a typical machine with two fans is described in our U.S. Pat. No. 3,019,793.

According to one aspect of the invention, there is provided a method of feeding tobacco to a cigarette machine comprising conveying tobacco particles in an air stream from a tobacco sender device to a hopper apparatus, metering tobacco from the hopper apparatus, and pneumatically conveying it in an air stream towards an air permeable suction band for formation, by withdrawal of the air stream, of a layer of tobacco for conveyance to a tobacco rod-forming means of the cigarette macking machine, wherein atmospheric air is induced into the sender device and utilized successively for entraining and conveying the tobacco particles from the sender to the hopper apparatus, and for entraining and conveying the tobacco particles from the hopper apparatus to the suction band, the particles being disentrained from the air flow at an entrance to the hopper apparatus, and metered tobacco from the hopper apparatus being reentrained in at least part of the same air flow, the hopper apparatus being operated at a subatmospheric pressure prevailing in the air stream separated from the tobacco particles received from the sender device.

According to another aspect of this invention, a system for feeding tobacco to a cigarette making machine comprises a tobacco sender device having means for entraining tobacco particles into a stream of air induced into the device, a first conveying duct for receiving the entrained particles, a hopper apparatus for receiving particles from the downstream end of the duct and including means at the entrance to the hopper apparatus for disentraining them from the conveying air stream, means for metering tobacco particles received from the hopper apparatus, a second duct for receiving said metered particles at the exit of the hopper apparatus, an air permeable suction band receiving said particles and forming them into a stream for conveyance to tobacco rod forming means of the cigarette making machine, and means for withdrawing air through said air-permeable band (and preferably also from said second duct at an intermediate position along the length thereof) whereby to convey said metered particles from the hopper apparatus and direct them towards said band, said hopper apparatus further comprising duct means having an inlet receiving air at subatmospheric pressure from said disentraining means and an outlet delivering air to tobacco particle entraining means downstream of said means for metering tobacco particles, and an enclosure for the hopper apparatus to maintain it at substantially said subatmospheric pressure, whereby at least part of the same air stream that is disentrained from the tobacco particles at the entrance to the hopper apparatus is utilised to reentrain them for conveyance through said second duct.

This invention dispenses with the need for an airlock at each cigarette making machine, and at least one of the fans normally provided at each machine, it also provides other advantages which will be apparent from the following description.

Further aspects of this invention are defined by the appended claims.

Examples of methods and apparatus embodying the various aspects and preferred features of this invention will now be described with reference to the accompanying drawings. In these drawings.

Figure 1:
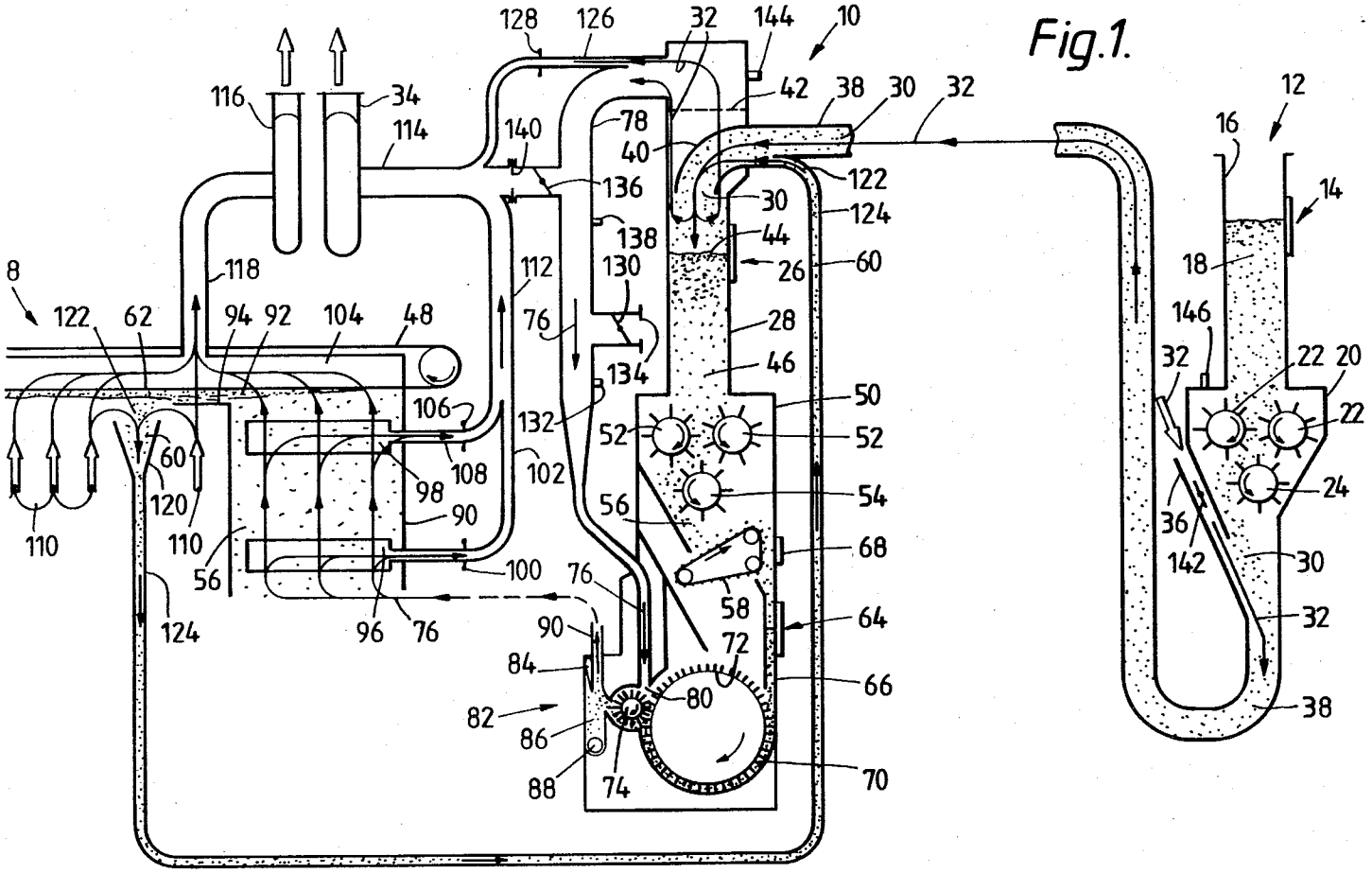
FIG. 1 is a schematic representation of a preferred embodiment of a system in accordance with the invention, wherein two fans are utilized.

Referring to the FIG. 1, the system comprises a continuously moving air-permeable suction band arrangement 8 associated with a cigarette making machine (not otherwise shown), hopper apparatus 10, and a tobacco sender device 12.

The tobacco sender device 12 receives cut tobacco in a container 16 equipped with a monitoring device 14 which monitors the tobacco level in the container 16 and regulates the supply of tobacco to the container from a source of unopened cut tobacco (not shown). The container 16 provides a reservoir of unopened cut tobacco 18 for continuously (or substantially continuously) supplying the hopper apparatus 10 with an adequate amount of tobacco for meeting the demands of the cigarette machine. The container 16 communicates at its lower end with a housing 20 containing a pair of pinned (pin carrying) counter-rotating metering drums 22 and a pinned opening drum 24, which premeter and preopen the unopened cut tobacco at a rate which is approximately equal to the rate at which tobacco is utilized in the formation of cigarette rod by the cigarette making machine from the filler on the suction band. This rate is regulated by monitoring device 26, located in a metering tube 28 of the hopper apparatus, which monitors the tobacco level in the tube 28 to provide a feedback signal which controls the rotational speed of the metering drums 22. If the device 26 comprises a vertical column of photocells, the speed may be regulated stepwise in accordance with the number of photocells uncovered by tobacco. An alternative giving rise to a substantially but not completely continuous feed might involve the drums 22 having a single speed but being stopped whenever the tobacco column in the tube 28 exceeds a predetermined height.

Premetered and preopened cut tobacco particles 30 from the sender device 12 are fed into a conveying air stream 32, which is induced by a vacuum set up in the housing 20 by a fan 34 associated with the cigarette making machine. Air 32 enters the housing 20 through an inlet 36 so as to entrain the tobacco particles 30 in the air stream 32 and convey them through a tobacco duct 38 to the hopper apparatus 10.

The air-conveyed tobacco particles 30 enter the hopper apparatus 10 through a downwardly curved pipe 40 opening into a zone above the level of tobacco contained in the metering tube 28. The tobacco particles 30 are disentrained in this zone of the metering tube 28. The flow of the conveying air 32 fluidizes an upper layer 44 of tobacco in the metering tube before it is drawn upwardly through a screen 42, and this fluidization evenly distributes the tobacco particles 30 across the width of the metering tube 28 (normal to the plane of the drawings) which may, for example, be approximately 600 mm where the diameter of the duct 38 may typically be 100 mm. The screen 42 separates the tobacco particles 30 from the conveying air stream 32.

The metering tube 28 receives the conveyed tobacco and thereby provides a tobacco reservoir 46 which communicates at its lower end with a housing 50 containing a pair of pinned counter-rotating metering drums 52 and a pinned opening drum 54. The opening drum 54 showers the metered and separated tobacco particles 56 onto a transport band 58 at a flow rate which is equal to the amount of tobacco required for formation of a cigarette rod plus a predetermined excess to allow for trimmed tobacco 60 cut off by a pair of trimmer discs 62 in the apparatus 8. The flow rate is regulated by a monitoring device 64 located at an equalizer column 66. The monitoring device 64 comprises a column of photocells which monitor the tobacco level in the column 66 and regulate the speed of the metering drums 52 stepwise in accordance with the number of photocells uncovered by tobacco.

The transport band 58 carries the separated tobacco particles 56 past a magnet 68 which removes any ferrous metal. The density equalizer column 66 is evenly and uniformly filled with the separated tobacco particles 56 and at its lower end discharges a tobacco carpet 70 of uniform density onto a transfer drum 72. A picker roller 74 then removes the tobacco particles from the drum 72 and projects them into a conveying air stream 76 at the required velocity. The speed of the drum 72 may be regulated by a device (not shown) monitoring the weight of the finished cigarette rod. The conveying air stream 76 is in fact a proportion of the conveying air stream 32, which bypasses the main portion of the hopper apparatus through air ducting 78 to a rectangular opening 80 which directs the air stream into the region between the transfer drum 72 and the picker roller 74.

The separated tobacco particles 56 are conveyed through a stem extraction device 82 comprising a guide 84, which can be adjusted to obtain a desired stem extraction action. Extracted stems 86 are fed by a screw conveyor 88 into a stem collector (not shown). From the extraction device 82 the separated tobacco particles 56 are conveyed by the air stream 76 up a chimney 90 to the suction band 48, which conveys a layer of accumulated tobacco particles 92 from the top of the chimney 90 through a chimney vacuum seal 94 to the pair of trimmer discs 62.

For convenience in illustrating the entire arrangement in one drawing, the upper part of the chimney 90 has been shown diagrammatically as though it has been turned through 90 degrees about a vertical axis. The same applies to FIG. 2.

Separation of the tobacco particles 56 from the conveying air stream 76 is executed in stages by means of two screens 96 and 98, located at the bottom and top of the chimney 90, and by means of the permeable suction band 48. An orifice plate 100, located in an air duct 102 which communicates with the screen 96, determines the amount of the airflow diverted into the air duct 102 from the conveying air stream 76, so that the remaining airflow will convey the tobacco particles 56 towards the suction band 48 at a predetermined velocity. The tobacco layer 92 and the air-permeable suction band 48 act in equivalent manner to an orifice plate and therefore a predetermined amount of airflow is removed from the chimney 90 into a suction chamber 104. An orifice plate 106, located in an air duct 108 which communicates with the screen 98, permits the remainder of the conveying air stream 76 to pass through the air duct 108. The airflows through the screens 96 and 98 have a "supercharging" effect in that they enable the tobacco to be conveyed into the chimney at a higher velocity than would be possible if the total airflow into the chimney were to be drawn through the suction band 48.

The suction chamber 104 is extended along the apparatus 8 beyond the chimney 90. As described above, the tobacco layer 92 and the air permeable suction band 48 act like an orifice plate and therefore a flow of air 110 of predetermined velocity flows from the surrounding atmosphere into the suction chamber 104. This velocity determines the degree of adhesion of the outer tobacco particles to the main body of the tobacco layer 92. The magnitude of the pressure drop across the tobacco layer 92 and the air-permeable suction band 48 determines the degree of adhesion of the tobacco layer 92 to the suction band 48. Proper control of transfer of the tobacco layer 92 from the chimney 90 into a garniture (not shown) of the cigarette making machine depends on the magnitudes of these two parameters, and the required vacuum in the suction chamber 104 will determine the suction head of a fan 116 connected to the chamber.

The air ducts 102 and 108 communicate with the fan 34 through the air ducts 112 and 114. The suction chamber 104 communicates with the fan 116 through an air ducting 118.

As mentioned above, the pair of trimmer discs 62 trim off a predetermined excess of the tobacco 60 into a collector 120. The collector 120 feeds the trimmed tobacco particles 60 into a conveying air stream 122 induced by the vacuum in the metering tube 28 of the hopper apparatus 10. The air stream 122 conveys the trimmed tobacco particles 60 through a trimmed tobacco duct 124 which merges with the tobacco duct 38, so that the tobacco particles 30 and 60 are mixed together, enter the vacuum hopper device 10 through the pipe 40 and are collected in the metering tube 28.

The tobacco velocity in the tobacco duct 38, which connects the sender device 12 to the hopper apparatus 10, is adjusted by an orifice plate 128 located in an air duct 126. The orifice plate 128 diverts part of the conveying air stream 32 through the air duct 126 into the main air duct 114 of the fan 34, so that the flow rate of the stream 32 can be adjusted without affecting the velocity of the air stream 76 which enters the rectangular opening 80 and passes through the extraction device 82 into the chimney 90.

In the event that, for some reason, the tobacco particles 30 from the tobacco sender device 12 plugged the entry to the tobacco ducting 38, the conveying air stream 32 would be interrupted. The velocity of the conveying air stream 76 would then be determined by the air flow through the trimmed tobacco ducting 124, but the resulting reduced velocity of the conveying air stream 76 would not be sufficient safely to convey the tobacco particles 56 from the picker roller 74 through the extraction device 82 and chimney 90 to the suction band 48. At the same time the lower air velocities through the orifice plates 100, 106 and 128 would considerably increase the vacuum in the chimney 90. Under these conditions the extraction device 82 and the chimney 90 will cease to operate, resulting in additional tobacco plugging this area. To prevent this from happening, an additional connection is provided from the atmosphere into the air duct 78 through a butterfly valve 130, which is controlled by a vacuum sensor 132 located at the air duct 78. The additional air flow is controlled by an orifice plate 134.

In the event that tobacco particles for some reason plugged the upper part of the chimney 90, the conveying air stream 32 in the tobacco ducting 38 and the conveying air stream 122 in the trimmed tobacco ducting 124 will not reach the required velocity for reliable conveying of the tobacco particles 30 or trimmed tobacco particles 60. This may cause additional tobacco blockages either at the entry into the tobacco duct 38 or at the entry to the trimmed tobacco duct 124 or at both locations. To prevent this from happening an additional air connection is provided to the air duct 78 from the duct 114 through a butterfly valve 136, which also is controlled by a vacuum sensor 138 located at the air duct 78. The additional air flow is controlled by an orifice plate 140.

It will be appreciated that the vacuum developed in the hopper apparatus 10 will be considerably reduced when there are no tobacco particles 30 in the conveying air stream 32, as will usually be the situation during start-up of the cigarette making machine. Decreased vacuum in the hopper apparatus 10 will automatically decrease the velocity of the conveying air stream 122 in the trimmed tobacco duct 124 resulting in a possible tobacco blockage in the entrance to the trimmed tobacco duct 124. To prevent this from happening an additional butterfly valve 142, which has an orifice in its hinged plate, is located in the inlet 36 to housing 20 of the sender device 12. This butterfly valve 142 is controlled by a vacuum sensor 144 located in the upper part of the hopper apparatus 10, the desired conveying velocity of the trimmed tobacco particles 60 then being determined by the size of the orifice in the plate of the butterfly valve 142.

In the event that the vacuum in the housing 20 of the tobacco sender device 12 decreases, the velocity of the conveying air stream 32 may decrease below an acceptable level. This will cause tobacco plugging in the entry to the duct 38. To prevent this from happening a vacuum sensor 146, located at the housing 20, stops the drums 22 and 24 to interrupt the discharge of the tobacco particles 30 from the tobacco sender device 12 into the conveying air stream 32.

Figure 2:
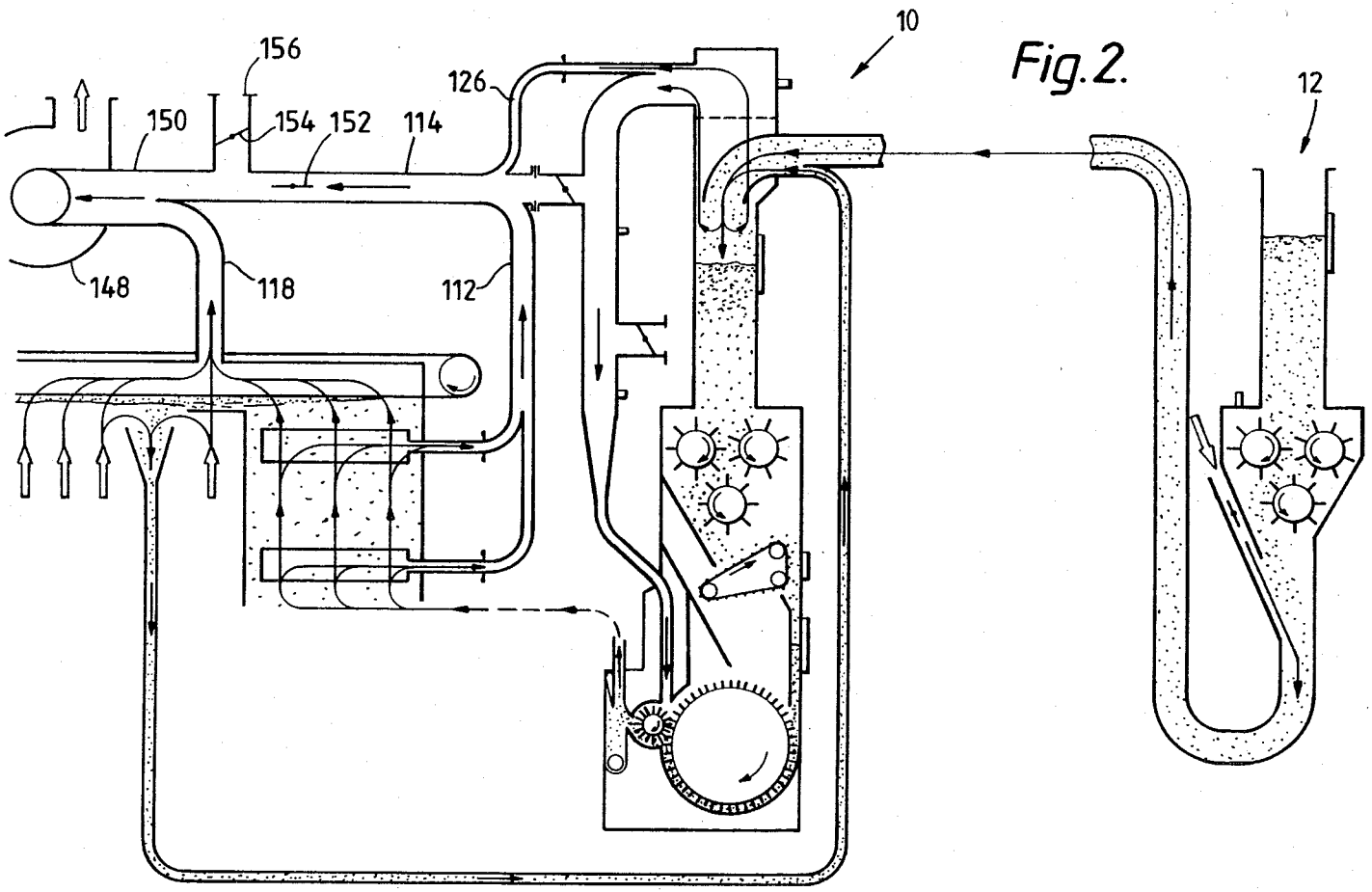
FIG. 2 is a schematic representation of a modification of the embodiment of FIG. 1, utilizing a single fan.

The apparatus shown in FIG. 2 is identical to that of FIG. 1 except that only one fan 148 is used in the system. With this configuration the air ducts 114 and 118 communicate through an air duct 150 with the fan 148. In order to maintain the same funtionality as in the previous embodiment two butterfly valves 152 and 154 together with an orifice plate 156 are associated with the duct 114. This arrangement allows the vacuum in the hopper apparatus 10 to be released if necessary. The additional air flow is controlled by the orifice plate 156 so that the vacuum in the suction chamber 104 is not changed.

Operation of the apparatus of FIG. 1 is as follows.

Under normal production conditions the butterfly valves 130 and 136 are closed and the valve 142 is open. The vacuum created by the fan 34 induces the conveying air stream 32 in which the premetered and preopened tobacco particles 30, drawn from the container 16 of the sender 12, are entrained. The tobacco particles 30 are then conveyed through the tobacco duct 38 into the metering tube 28 of the hopper apparatus 10. Metered and opened tobacco particles 56 are then showered onto the transport band 58, carried past the magnet 68 which removes any ferrous metal, and subsequently fed into the density equalizer column 66. The density equalizer column 66 discharges a uniform tobacco carpet 70 onto the transfer drum 72. The picker roller 74 then projects the separated tobacco particles 56 of the tobacco carpet 70 into the conveying air stream 76, which is a partial continuation of the conveying air stream 32. The separated tobacco particles 56 are conveyed through the stem extraction device 82, and then conveyed by the air stream 76 up the chimney 90 onto the suction band 48, which then conveys a layer 92 of accumulated tobacco particles 56 from the top of the chimney 90 through a chimney vacuum seal 94, past the pair of trimmer discs 62, and into the rod-forming device (not shown) of the cigarette making machine. The trimmed tobacco 60 is fed into the conveying air stream 122 and conveyed through the trimmed tobacco duct 124 back into the metering tube 28 of the hopper apparatus 10.

If the cigarette making machine, including the moving parts of the hopper apparatus 10, stops for any reason then the monitoring device 26 located in the metering tube 28 of the vacuum hopper device 10 detects a rise in tobacco level in the metering tube and interrupts the discharging of the tobacco particles 30 from the sender device 12 into the conveying air stream 32. When a suitable purge interval has elapsed (so as to empty the tobacco duct 38 of tobacco particles 30) then the fan 34 is stopped and the butterfly valve 142 in the tobacco sender device 12 is closed. The system is then ready for the restarting of the cigarette making machine.

In the event that the tobacco particles 30, discharged from the tobacco sender device 12, have for some reason plugged the entry of the tobacco duct 38, the vacuum sensor 146 in the housing 20 of the tobacco sender device 12 interrupts the discharge of the tobacco particles 30. At the same time the vacuum sensor 132, located in the air duct 78, opens the butterfly valve 130 and stops the cigarette making machine. When the tobacco blockage is removed and the system is ready for operation, a logic unit closes the butterfly valve 130 and starts the system commencing with a purge interval. When the purge interval has elapsed then the butterfly valve 142 is closed and the system is ready for start-up of the cigarette machine.

In the event that the tobacco particles 56 have for some reason plugged the upper part of the chimney 90, the vacuum sensor 138 opens the butterfly valve 136 and stops the cigarette making machine. The monitoring device 26, located at the metering tube 28 of the vacuum hoprat 10, interrupts the discharge of the tobacco particles 30 from the tobacco sender 12 into the conveying air stream 32. When a purge time has elapsed, the fan 34 stops and the butterfly valve 142 in the tobacco sender device 12 closes. When the tobacco blockage is removed, the system is ready for start-up of the cigarette making machine.

An unacceptably high pressure loss across the dust separator, located in the cigarette making machine, or the screen 42, located in the upper part of the hopper apparatus 10, will decrease the vacuum in the housing 20 of the tobacco sender device 12, and the same effect may be caused by an unacceptably high leakage of air from the atmosphere into the system. The velocity of the conveying air stream 32 may not then reach the required velocity for safe conveying of the tobacco particles 30, and thus when the vacuum in the housing 20 decreases to a critical level, the vacuum sensor 146 interrupts the discharge of the tobacco particles 30 and stops the cigarette making machine. When the purge time elapses, the fan 34 stops and the butterfly valve 142 closes. Upon re-establishing the vacuum, the system is ready for restarting of the cigarette making machine. In the event that the supply of the cut tobacco into the metering tube 16 of the tobacco sender device 12 is interrupted, the monitoring device 14, located at the metering tube 16, stops the discharge of tobacco particles from the tobacco sender 12. The monitoring device 26 then stops the cigarette making machine. When the purge time elapses, the butterfly valve 142 closes. When the tobacco supply is restored, the system is ready for restarting of the cigarette making machine.

During start-up of the cigarette making machine, the monitoring device 26 located in the metering tube 28 of the vacuum hopper apparatus 10 starts the discharge of tobacco particles 30 from the tobacco sender device 12 into the air stream 32. When the vacuum in its vicinity reaches a required level, the vacuum sensor 144 opens the butterfly 142. The system then operates under normal production conditions.

The embodiment shown in FIG. 2 operates similarly except that the fan 34 in the FIG. 1 is replaced by the pair of butterfly valves 152 and 154 as described above.

In FIG. 1, and likewise in FIG. 2, additional provision may be made for positively spreading the flow of tobacco from the duct 38 across the width of the metering tube 28 in any known manner, for example by means of fixed deflectors or by means of an oscillating deflector. It will be understood in this connection that the width of the metering tube 28 (e.g. 600 mm) corresponds to that of the chimney 90.

The conveyor 58 may be replaced by a drum.

We claim:

1. A method of feeding tobacco to a cigarette machine, comprising conveying tobacco particles in an air stream from a tobacco sender device to a hopper apparatus, metering tobacco in the hopper apparatus, and pneumatically conveying it in an air stream towards an air-permeable suction band for formation, by withdrawal of the air stream, of a layer of tobacco for conveyance to a tobacco rod-forming means of the cigarette making machine, wherein atmospheric air is induced into the sender device and utilized successively for entraining and conveying the tobacco particles from the sender to the hopper apparatus, and for entraining and conveying the tobacco particles from the hopper apparatus to the suction band, the particles being disentrained from the air flow at an entrance to the hopper apparatus, and metered tobacco from the hopper apparatus being reentrained in at least part of the same air flow, the hopper apparatus being operated at a subatmospheric pressure prevailing in the air stream separated from the tobacco particles received from the sender device.

2. A method according to claim 1 in which the air reentraining the tobacco particles metered from the hopper is drawn partly through the suction band and partly through at least one screen in a duct through which tobacco particles are conveyed to the suction band.

3. A method according to claim 1 in which the vacuum level is detected at one or more points in the system to produce one or more signals for controlling valves which operate automatically to ameliorate adverse conditions caused by the eventuality of tobacco plugging of a duct.

4. A method according to claim 1 in which tobacco is conveyed substantially continuously from the sender device to the hopper apparatus at a rate or average rate controlled by the level of accumulated tobacco in the hopper apparatus, so as to maintain the accumulated level substantially constant.

5. A method according to claim 4, wherein the particles from the sender device form a fluidized bed at the entrance to the hopper apparatus, from which bed the particles are disentrained.

6. A method for processing cut tobacco to form a stream of tobacco particles on a continuously moving air-permeable suction band feeding the stream to tobacco rod-forming means of a cigarette making machine, comprising:

feeding unopened cut tobacco into a tobacco sender, located remote from said cigarette making machine, to provide a source of preopened and premetered tobacco particles suitable for air conveying, entraining said tobacco particles from said tobacco sender into a stream of air induced into said sender device by fan means located in or in the vicinity of said cigarette making machine, conveying said air stream and said entrained tobacco particles from said tobacco sender device through a tobacco duct to an upper zone of a hopper apparatus which is closed to maintain a subatmospheric pressure therein, metering said particles from the bottom of said upper zone, and conveying said tobacco particles into a density equalizer column of said hopper apparatus, transferring density-equalized tobacco particles by a transfer drum from said density equalizer column to a picker roller of said hopper apparatus, disengaging said tobacco particles from said transfer drum by said picker roller, reentraining said tobacco particles in at least part of said air stream disentrained from the particles entering the hopper and directed by a duct into the region of said picker roller, conveying said tobacco particles by said air stream out of said hopper apparatus and up a chimney towards said suction band, and withdrawing said air stream from said tobacco particles into at least one duct connected to said fan means to permit formation of said bed of tobacco particles on said suction band.

7. A method according to claim 6, wherein said air stream is induced by two fans located at or in said cigarette making machine, one fan inducing part of said air stream through the air permeable suction band, and the other fan inducing the remainder of said air stream through at least one screen in said chimney.

8. A method according to claim 6, wherein the reentrained particles leaving the hopper apparatus are passed through a stem remover.

9. A method according to claim 6, wherein excess tobacco particles are trimmed by trimmer discs from the stream of tobacco on the air-permeable suction band for return to the hopper, and wherein said excess tobacco particles are entrained in an air stream induced by the subatmospheric pressure in the reservoir of the hopper apparatus, and the entrained particles are conveyed by the induced air stream to the reservoir.

10. A system for feeding tobacco to a cigarette making machine, comprising a tobacco sender device having means for entraining tobacco particles into a stream of air induced into the device, a first conveying duct for receiving the entrained particles, a hopper apparatus for receiving particles from the downstream end of the duct and including means at the entrance to the hopper apparatus for disentraining them from the conveying air stream, means for metering tobacco particles received from the hopper apparatus, a second duct for receiving said metered particles at the exit of the hopper apparatus, an air-permeable suction band receiving said particles and forming them into a stream for conveyance to tobacco rod-forming means of the cigarette making machine, and means for withdrawing air at least through said air-permeable band whereby to convey said particles from the hopper apparatus and direct them towards said band, said hopper apparatus further comprising hopper duct means having an inlet receiving air at subatmospheric pressure from said disentraining means and an outlet delivering air to tobacco particle reentraining means downstream of said means for metering tobacco particles, and an enclosure for the hopper apparatus to maintain it at substantially said subatmospheric pressure, whereby at least part of the same air stream that is disentrained from the tobacco particles at the entrance to the hopper apparatus travels through said hopper duct means and is utilized in said reentraining means to reentrain them for conveyance through said second duct.

11. Apparatus according to claim 10 including means for withdrawing air from said second duct through at least one screen.

12. Apparatus according to claim 11 in which said means for withdrawing air through at least one screen comprises a fan which is separate from a fan which withdraws air through said air-permeable band.

13. Apparatus according to claim 11 in which a common fan is arranged to draw air through the band and at least one screen.

14. Apparatus according to claim 10 including one or more additional air flow ducts arranged to ameliorate adverse conditions caused by the eventuality of tobacco plugging of a duct.

15. Apparatus according to claim 14 including one or more valves controlled by vacuum sensors to ameliorate adverse conditions caused by the eventuality of tobacco plugging of a duct.

16. Apparatus according to claim 10 in which the tobacco sender device is arranged to convey tobacco substantially continuously to the hopper apparatus at a rate or average rate controlled by the level of accumulated tobacco in the hopper apparatus, so as to maintain the accumulated level substantially constant.

17. Apparatus according to claim 16, wherein said tobacco sender device comprises a container for receiving and storing cut tobacco, two counter-rotating metering drums beneath the container for advancing cut tobacco therefrom at a feed rate approximately equal to the requirements of the cigarette making machine, an opening drum beneath the metering drums for separating said cut tobacco into particles suitable for air entrainment and discharging the particles into an entrainment zone leading to said tobacco duct to the hopper apparatus, and means defining an air inlet into said entrainment zone through which an air stream for entraining said tobacco particles is induced.

18. Apparatus according to claim 17, wherein said hopper apparatus comprises a tobacco reservoir defined within said enclosure which has a top entrance portion in which the tobacco conveying duct from the sender device terminates, and which forms a fluidization chamber in which tobacco particles separate from the conveying air stream, two counter-rotating metering drums beneath the reservoir for advancing tobacco particles therefrom at the required feed rate, an opening drum beneath the metering drums for separation of said tobacco particles, said opening drum discharging separated tobacco particles onto a conveyor, a density equalizing duct receiving tobacco particles delivered by said conveyor, a transfer drum for transferring density equalized tobacco particles from said density equalizing duct to a picker roller for engaging said tobacco particles from said transferring drum, and a bypass duct receiving at least part of the air stream separated from the tobacco particles in the entrance portion and discharging into an opening in the region of said picker roller so as to entrain the disengaged tobacco particles and convey them into and through the second duct.

19. Apparatus according to claim 18, wherein the top portion of the reservoir contains a downwardly curved duct forming the downstream end of the tobacco duct from the sender device, oriented to direct said air stream towards the upper surface of tobacco particles accumulated in the reservoir so that the air stream penetrates and fluidizes the uppermost portion of said tobacco particles, and a screen above the end of the duct for intercepting stray tobacco particles at the entrance to the bypass duct.

20. Apparatus according to claim 18, wherein stem extraction means are located at the exit of the hopper apparatus for separating stems from said entrained tobacco particles, and wherein a vertically extending chimney forms the second duct for air conveyance of said tobacco particles upwards to the continuously moving air-permeable suction band, which closes the upper end of said chimney.

21. Apparatus according to claim 20, wherein said stem extraction means comprises a curved channel whose curvature conforms to that of the picker roller, an adjustable guide to divert heavy stem particles separated from said tobacco particles, and means for collecting and removing said stem particles.

22. Apparatus according to claim 20, wherein said chimney includes a lower screen for extracting a portion of said air stream so that said tobacco particles are conveyed up said chimney to said air-permeable suction band at a predetermined conveying velocity, and an upper screen for extracting remaining air in excess of that withdrawn through said tobacco filler and air-permeable suction band into a vacuum chamber above said band.

23. Apparatus according to claim 10, wherein a pair of trimmer discs is located to trim excess tobacco from the tobacco carried by said air-permeable band, a collector is located to collect trimmed tobacco particles removed by said pair of ecreteur discs, and a duct connects said collector to the entry region of said hopper apparatus whereby the subatmospheric pressure in said hopper apparatus induces an air flow in said duct which entrains said trimmed tobacco particles and returns them to the hopper apparatus.

* * * * *